US007473185B2

(12) United States Patent
Anderson et al.

(10) Patent No.: US 7,473,185 B2
(45) Date of Patent: Jan. 6, 2009

(54) GOLF PUTTER

(76) Inventors: Carl T. Anderson, 3729 E. Nance Cir., Mesa, AZ (US) 85215; David A. Zamora, 2625 N. 24th St., Suite 24, Mesa, AZ (US) 85213

( * ) Notice: Subject to any disclaimer, the term of this patent is extended or adjusted under 35 U.S.C. 154(b) by 55 days.

(21) Appl. No.: 11/652,738

(22) Filed: Jan. 11, 2007

(65) Prior Publication Data

US 2008/0171614 A1 Jul. 17, 2008

(51) Int. Cl.
*A63B 53/04* (2006.01)

(52) U.S. Cl. ..... 473/325; 473/330; 473/340; 473/345

(58) Field of Classification Search ..... None
See application file for complete search history.

(56) References Cited

U.S. PATENT DOCUMENTS

| | | | | | |
|---|---|---|---|---|---|
| 653,483 | A | * | 7/1900 | McCrea | 473/293 |
| 1,116,022 | A | * | 11/1914 | Cornwall | 473/558 |
| 1,177,266 | A | * | 3/1916 | Pedesen | 473/558 |
| 1,478,483 | A | * | 12/1923 | Meurisse | 473/558 |
| 1,902,660 | A | * | 3/1933 | Nelson | 473/558 |
| 1,918,485 | A | * | 7/1933 | Nelson | 473/558 |
| 4,861,038 | A | * | 8/1989 | Fucinato | 473/328 |
| 4,871,174 | A | * | 10/1989 | Kobayashi | 473/252 |
| 5,362,056 | A | * | 11/1994 | Minotti | 473/251 |
| 5,409,219 | A | * | 4/1995 | Saksun, Sr. | 473/305 |
| 5,433,441 | A | * | 7/1995 | Olsen et al. | 473/328 |
| D368,292 | S | * | 3/1996 | Willoughby | D21/738 |
| 5,501,461 | A | * | 3/1996 | Donofrio | 473/251 |
| 5,577,965 | A | * | 11/1996 | Burgess | 473/230 |
| 5,580,058 | A | * | 12/1996 | Coughlin | 273/250 |
| 5,588,923 | A | * | 12/1996 | Schmidt et al. | 473/340 |
| 5,632,694 | A | * | 5/1997 | Lee | 473/336 |
| 5,637,044 | A | * | 6/1997 | Swash | 473/331 |
| 5,688,189 | A | * | 11/1997 | Bland | 473/314 |
| 5,865,687 | A | * | 2/1999 | Alzano | 473/313 |
| 5,947,841 | A | * | 9/1999 | Silvestro | 473/341 |
| 5,993,324 | A | * | 11/1999 | Gammil | 473/251 |
| D444,524 | S | * | 7/2001 | Reeves, Jr. | D21/738 |
| 6,447,403 | B1 | * | 9/2002 | Schmidt | 473/251 |
| 6,579,193 | B1 | * | 6/2003 | McDowell | 473/251 |
| 7,029,404 | B2 | * | 4/2006 | Lu | 473/334 |
| 7,169,058 | B1 | * | 1/2007 | Fagan | 473/293 |
| 7,374,500 | B2 | * | 5/2008 | Engdahl | 473/340 |

FOREIGN PATENT DOCUMENTS

| | | | |
|---|---|---|---|
| GB | 2278063 | A * | 11/1994 |
| JP | 2002165910 | A * | 6/2002 |

* cited by examiner

*Primary Examiner*—Gene Kim
*Assistant Examiner*—Alvin A Hunter
(74) *Attorney, Agent, or Firm*—Tod R. Nissle, P.C.

(57) ABSTRACT

A free standing golf putter is provided and configured to contact a golf ball at a point above the center of the golf ball. The mass of the central portion of the putter is greater than the mass of the toe and heel of the putter. The putter is utilized to view and evaluate the slope of a green by placing the putter in an upright, free standing orientation, by stepping away from the putter with the putter intermediate the golfer and hole, and by viewing the green to either side of the putter shaft.

1 Claim, 3 Drawing Sheets

GOLF PUTTER

This invention relates to the game of golf.

More particularly, the invention relates to a golf putter.

One objective strived for during putting is to strike a golf ball so that the ball rolls from the putter face directly over the surface of the green and does not lift away from the surface of the green or, at worst, become airborne.

Another objective sought during putting is to minimize movement of the putter head from a desired path of travel both during the back swing and follow through of the putter.

A further objective desired during putting is to avoid disrupting a putting stroke by scuffing the bottom of the putter on the green.

Still another objective desired during putting is to accurately read the slope or "break" of the surface of a putting green.

Still a further, although lesser, objective during putting is to avoid inadvertently leaving a putter behind when moving on to play the next hole.

Accordingly, it would be highly desirable to provide an improved golf putter that would facilitate meeting most, if not all, of the foregoing delineated putting objectives.

Therefore, it is a principal object of the instant invention to provide an improved golf putter.

Other objectives of the invention include providing an improved golf putter that promotes striking a ball so the ball maintains contact with and rolls over the surface of a green; that increases the stability of the putter head; that minimizes the likelihood the putter head will contact the surface of a green; that facilitates utilizing the putter to evaluate the slope of a green; and, that reduces the risk that the putter will inadvertently be left behind when a golfer moves on to play the next hole.

These and other, further and more specific objects and advantages of the invention will be apparent to those skilled in the art from the following detailed description thereof, taken in conjunction with the drawings, in which.

Figure 1:
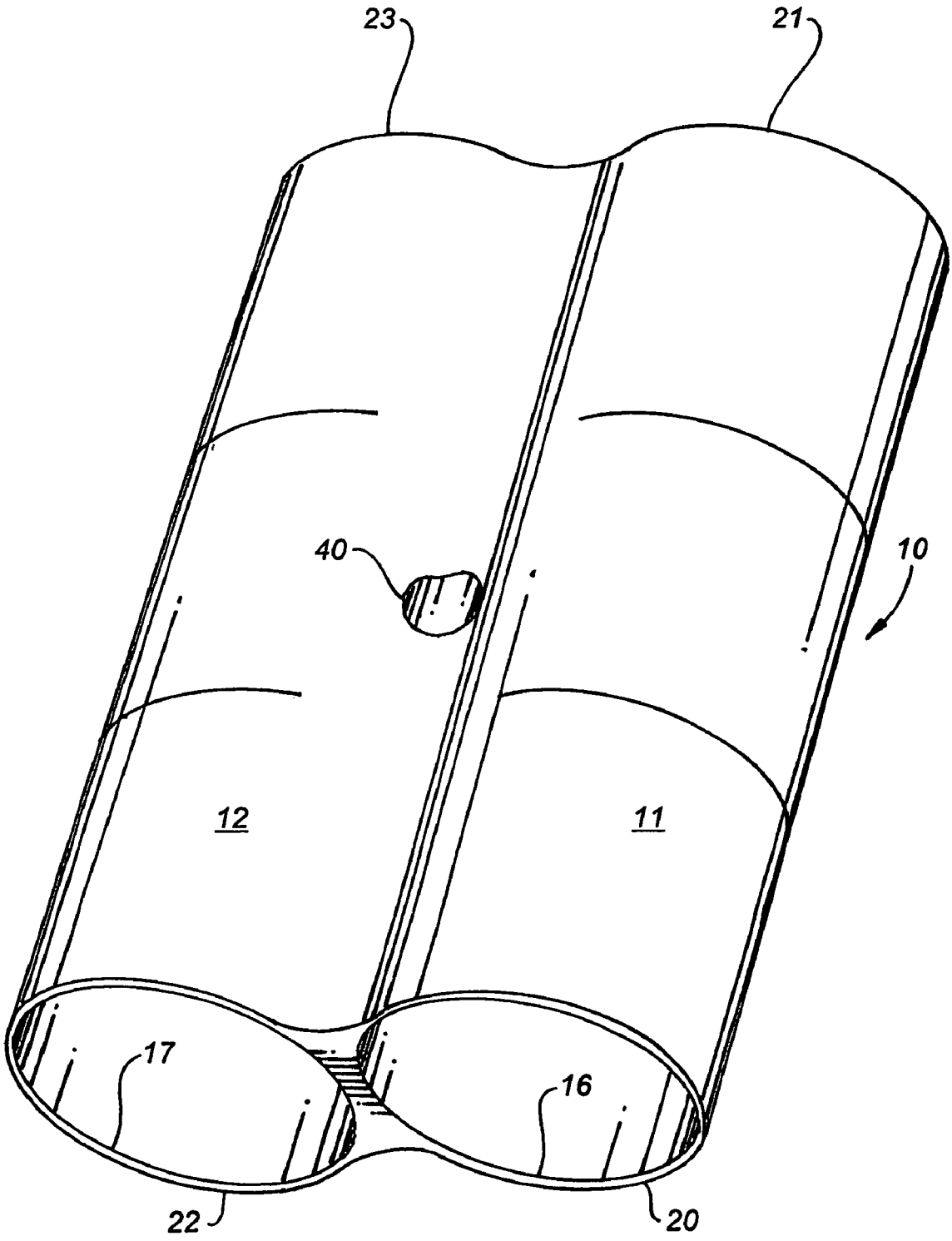
FIG. 1 is a perspective view illustrating a putter constructed in accordance with the principles of the invention.

Briefly, in accordance with the invention, I provide an improved golf putter. The putter comprises a head having a center of gravity and comprising a pair of interconnected hollow cylindrical members having opposing ends and outer rounded ball contacting surfaces and shaped and dimensioned that the center of gravity is generally centrally located intermediate the ends; the outer rounded ball contacting surfaces contact a golf ball at a point above the center of the golf ball; and, the putter is free standing. The putter also includes a shaft having a proximate end connected to the head generally at the center of gravity, and a distal end including a handle.

In another embodiment of the invention, I provide an improved method of viewing the slope of a putting green. The method comprises the steps of providing a putter with a shaft, and a head connected to the shaft and shaped and dimensioned such that the putter freely stands on the ground with the shaft extending upwardly from the head; setting the said putter on the green to free stand with the shaft extending upwardly from the head; and, viewing the shaft and the green from a position remote from the free standing putter.

Turning now to the drawings, which illustrate the presently preferred embodiments of the invention, and in which like reference characters correspond to similar elements throughout the several views, FIGS. 1 to 4 illustrate a putter including head 10 consisting of a pair of interconnected hollow cylindrically shaped members 11 and 12. Member 11 includes an inner channel 16 passing therethrough from one end 20 to the other end 21 of member 11. Channel 16 tapers inwardly from ends 20 and 21 in a generally conical fashion to a smaller diameter portion 18 that interconnects the conical portions of channel 16. Similarly, channel 17 tapers inwardly from ends 22 and 23 of member 12 in a generally conical fashion to a smaller diameter portion 19 that interconnects the conical portions of channel 17. Channels 16 and 17 can be shaped and dimensioned as desired as long as channels 16 and 17 function to produce more mass in the center of the putter head.

The production of greater mass at the center of the putter head is an important feature of the invention because it produces more inertia in the center of the putter head and tends to reduce the likelihood that the putter head will twist due to torque forces generated by the heel or toe of the putter head. The inner or central portion of the putter head, indicated by arrows B in FIG. 2, has mass that is greater than the combined mass of the outer portions, indicated by arrows A and C in FIG. 2, of the putter head. The length, indicated by arrows B, of the central portion of the putter head is up to 50% of the entire length of the putter head (where the entire length equals the sum of the lengths indicated by arrows A, B, C in FIG. 2 or by arrow G in FIG. 3) of the putter head, preferably is up to 40% of the entire length of the putter head, more preferably is up to 30% of the entire length of the putter head, and most preferably is up to 20% of the entire length of the putter head. For example:

1. If the length of the central portion (indicated by arrows B) of the putter head is 40% of the entire length, then the mass of the central portion is greater than the mass in the remaining 60% of the length of the putter head, which remaining 60% is indicated by arrows A and C.
2. If the length of the central portion of the putter head is 20% of the entire length, then the mass of the central portion is greater than the mass in the remaining 80% of the length of the putter head. The length of the putter head is, as indicated by arrows A to C, measured from the heel of the putter head to the toe of the putter head.
3. If the central portion (indicated by arrow B) of the putter head is one inch long (20% of the total length) and the combined length of the remaining portions (indicated by arrows A and C) of the putter head is four inches (80% of the total length), then the mass, or weight, of the central portion of the putter head is greater than the mass, or weight, of the remaining portions of the putter head.

And so on.

Although the length of the putter head can vary as desired, the length of the putter head currently is at least three inches, preferably at least four inches, and most preferably at least five inches.

The diameter of cylindrical members 11 and 12 is such that when the outer cylindrical surface 11A contacts a golf ball, it preferably, although not necessarily, contacts the ball 30 at a point 32 that is slightly higher above the ground than is the center 31 of the golf ball. This produces a small downward force on the ball that tends to maintain the ball on the green and reduce the risk that the ball will be lifted off the green. This is an important feature of the invention because its facilitates a golfer controlling the path of travel of a golf ball on a putting green.

Figure 3:
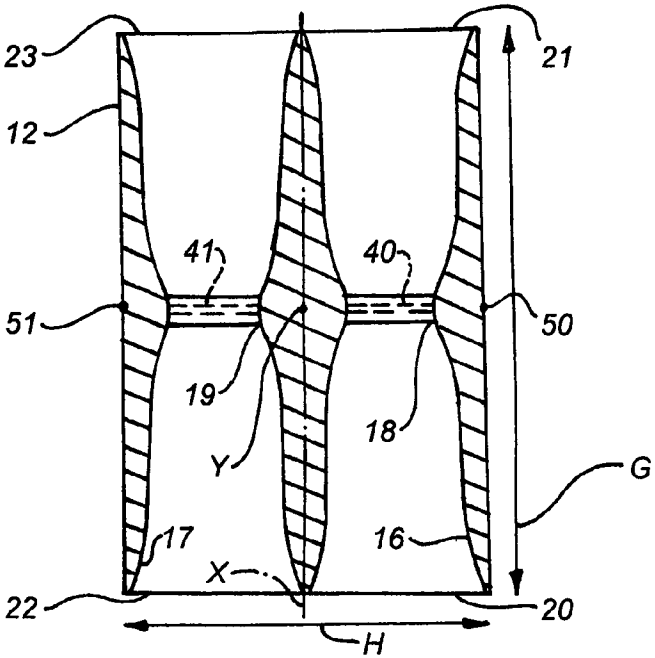
FIG. 3 is a top section view illustrating further construction details of the putter of FIG. 2; and, FIG. 4 is a left side view of the putter of FIG. 2 illustrating further construction details thereof.
Figure 4:
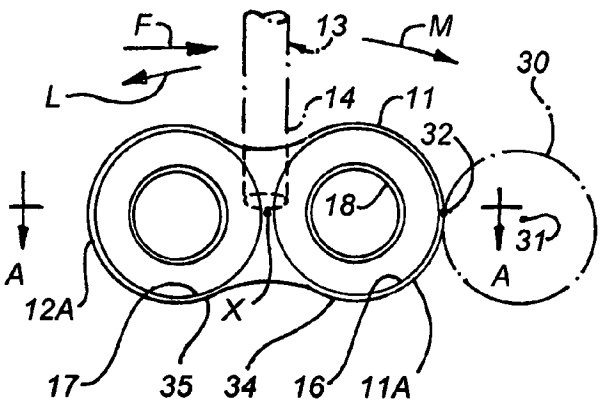

The cylindrical outer surface 11A, 12A of each member 11, 12 tends to produce more of a point contact with a golf ball than with a putter face that is flat. The point contact of a cylindrical outer surface 11A, 12A produces, for some golfers, a contact that feels "cleaner". The incorporation of the hollows 18, 19 behind the points 50 and 51 where the putter head 10 preferably contacts a golf ball also produces, for some golfers, a contact that feels "cleaner" or "sharper". However, the hollows can also, when a golf ball is struck with head 10, produce a sharp sound undesirable to a golfer. In order to maintain incorporation of critical hollow areas in the putter head, circular sound dampening panels 40 and 41 are, if desired, incorporated in hollows 18, 19 behind the points 50 and 51 where the putter head 10 contacts a golf ball. One or more panels 40, 41 can be incorporated at any desired location along each hollow 18, 19, although the centralized location shown in FIG. 3 is presently preferred as appearing to be the most efficient at dampening sound produced when head 10 strikes a golf ball.

The pair 11, 12 of hollow cylindrical members is utilized and believed important because if only a single cylindrical member is utilized it is difficult to extend a hollow channel completely through the member because the distal end 14 of shaft 13 is connected to the center of the putter head. In an alternate embodiment of the invention, a single, larger diameter cylindrical member is utilized in place of members 11 and 12 and includes a pair of hollow channels that extend through the larger diameter cylindrical members and pass to either side of distal end 14 embedded in the center of the large diameter cylindrical member. Members 11, 12 need not be identical or symmetrical and can have outer surfaces that are, instead of being cylindrically shaped, elliptically or otherwise shaped as long as the outer ball contacting surfaces of the putter head are arcuate.

The cylindrical outer surface 11A, 12A of each member 11, 12 also tends to produce a linear contact with a golf green, which minimizes the likelihood that the bottom of head 10 will scruff or catch on the surface of the green; and, in the event a surface 11A, 12A does contact the surface of the green, it is more likely that such contact will not significantly affect the putting stroke.

Figure 2:
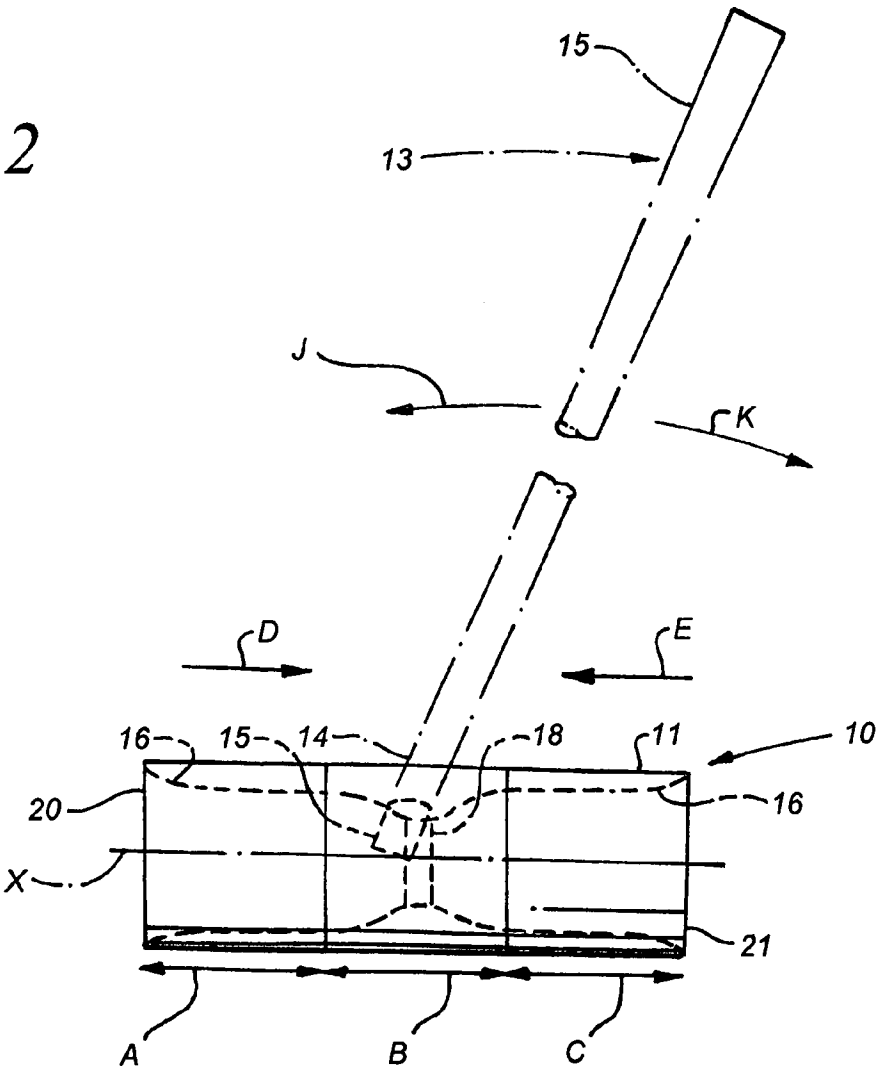
FIG. 2 is a side view further illustrating the putter of FIG. 1

When putter head 10 is set down on a green in the orientation illustrated in FIG. 2, the putter is free standing. The putter is free standing because it remains in the upright orientation of FIG. 2 of its own accord. If a golfer releases his or her grip on the handle 15, the putter will not, as will most or all putters, fall over such that the shaft 13 contacts the putting surface of a green. Instead, the putter remains in the orientation of FIG. 2 with shaft 13 extending upwardly away from head 10 and from the putting surface of the green, and, with the lower portions 34, 35 of outer surface 11A and 12A contacting the surface of the green. Since the putter of the invention is free standing, it is more noticeable when left in a free standing orientation, which reduces the risk that the putter will be inadvertently left behind after the putter's owner finishes putting and moves on to the next hole on a golf course. In order for the putter to be free standing, the foot print of the head of the putter must be sufficiently wide (or the head must be appropriately shaped and dimensioned) and the head must have sufficient weight or have an appropriate weight distribution to prevent the shaft and head from tilting in the directions indicated by arrows L and M in FIG. 4, and to prevent the shaft 13 and head from tilting in the directions indicated by arrows J and K in FIG. 2. As the weight of shaft 13 decreases, the magnitude of the force that results from gravity acting on the handle and that tends to tip shaft 13 and the putter head in the direction of arrow K decreases. Similarly, as the angle of shaft 13 with respect to the ground approaches ninety degrees, the magnitude of the force that results from gravity acting on the handle and that tends to tip shaft 13 and the putter head in the direction of arrow K decreases. It is presently preferred that when the putter of the invention is being utilized and is addressing the ball in the manner illustrated in FIGS. 2 and 4, that shaft 13 be canted with respect to the ground and not be normal to the ground. Most conventional putters utilize a shaft 13 that is canted with respect to the ground and with respect to the putter head, as is the case of shaft 13 in FIG. 2.

The proximate end 14 of shaft 13 is fixedly secured in aperture 40 of putter head 10. Aperture 40 is preferably, but not necessarily, formed at the center of gravity, or mass, Y (FIG. 3) of putter head 10. End 14 contributes to the mass at the center of the putter head 10.

When a golfer is attempting to view the slope of a green, the golfer places the putter of the invention on the green in the free standing orientation with, for example, the longitudinal axis X of the putter pointed toward the hole (or pointed in some other desired direction on the green). The golfer then walks a selected distance away from the putter and hole such that the putter is between the golfer and the hole and is aligned with the hole. The golfer then looks toward the hole in the direction of arrow D or E in FIG. 2, as the case may be, and views the surface of the green to either side of the putter shaft 13 to evaluate the slope, if any, of the surface of the green.

Alternatively, the golfer places the putter in the free standing orientation with the longitudinal axis X of the putter tangential to the hole (or normal to a line extending from the putter head to the hole). The golfer then, again, walks a selected distance away from the puffer and hole such that the putter is between the golfer and hole and is aligned with the hole. The golfer then looks toward the hole in the direction of arrow F in FIG. 4, and views the green surface to either side of the putter shaft 13 to evaluate the slope, if any, of the green surface.

Having described my invention in such terms as to enable those skilled in the art to understand and practice it, and having described the presently preferred Embodiments thereof, We claim:

1. A golf puffer comprising (a) a head having a center of gravity and comprising first and second parallel interconnected hollow cylindrical members each (i) having first and second open opposed ends (20, 21), and a center (B) with a first mass and a first selected length, (ii) having an outer rounded ball contacting surface with a diameter generally equivalent to the outer rounded ball contacting surface of the other of said interconnected hollow cylindrical members, (iii) having a centerline extending perpendicular to the normal direction of travel of said club head when striking a golf ball, (iv) having a first portion (A) with a mass, a second selected length, and a first inwardly tapered channel extending inwardly from said first open end, (v) having a second portion (C) with a mass, a third selected length, and a second inwardly tapered channel extending inwardly from said second end, the cumulative masses of said first and second portions being less than the mass of said center, said first selected length being up to 50% of the entire length of said head, with said second and third lengths comprising the remainder of the entire length of said head, (vi) shaped and dimensioned that said center of gravity is generally centrally located intermediate said ends, said outer rounded ball contacting surfaces contacts a golf ball at a point above the center of the golf ball, and the puller is free standing; and, (b) a shaft having (i) a proximate end connected to said head generally at said center of gravity, and (ii) a distal end including a handle.

* * * * *